US009232302B2

(12) United States Patent
Minoo et al.

(10) Patent No.: US 9,232,302 B2
(45) Date of Patent: Jan. 5, 2016

(54) MICROPHONE ASSEMBLIES WITH THROUGH-SILICON VIAS

(75) Inventors: Jahan Minoo, San Jose, CA (US); Nicholas C. Seroff, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 248 days.

(21) Appl. No.: 13/149,626

(22) Filed: May 31, 2011

(65) Prior Publication Data

US 2012/0308045 A1 Dec. 6, 2012

(51) Int. Cl.

| | |
|---|---|
| ***H04R 3/00*** | (2006.01) |
| ***H04R 25/00*** | (2006.01) |
| ***H04R 1/34*** | (2006.01) |
| *H04R 1/08* | (2006.01) |
| *H04R 19/00* | (2006.01) |

(52) U.S. Cl.
CPC ..... *H04R 1/342* (2013.01); *H04R 1/086* (2013.01); *H04R 19/005* (2013.01)

(58) Field of Classification Search
CPC .... B81C 1/00238; H04R 1/086; H04R 1/342; H04R 19/005
USPC ..... 381/122, 111, 174, 175, 190, 191, 355, 381/398, 113, 369, 150; 379/428.01, 379/420.03, 433.03; 257/710, 265, 334, 257/337, 476, 491
See application file for complete search history.

(56) References Cited

U.S. PATENT DOCUMENTS

| | | | |
|---|---|---|---|
| 4,175,816 A | 11/1979 | Burr et al. | |
| 5,826,708 A | 10/1998 | Finlay | |
| 6,518,527 B2 | 2/2003 | Watanabe et al. | |
| 6,928,726 B2 | 8/2005 | Zollo et al. | |
| 7,094,985 B2 | 8/2006 | Kobayashi et al. | |
| 7,263,194 B2 * | 8/2007 | Niederdrank et al. | 381/324 |
| 7,676,242 B2 | 3/2010 | Siddiqui et al. | |

(Continued)

FOREIGN PATENT DOCUMENTS

EP 2 037 700 A2 3/2009

OTHER PUBLICATIONS

Ankur O. Aggarwal, 50 Micron Pitch Wafer Level Packaging Testbed with Reworkable IC-Package Nano Interconnects, 2005 Electronic Components and Technology Conference, Abstract.*

(Continued)

*Primary Examiner* — Vivian Chin
*Assistant Examiner* — William A Jerez Lora
(74) *Attorney, Agent, or Firm* — Blakely, Sokoloff, Taylor & Zafman LLP

(57) ABSTRACT

Microphone assemblies may be provided that have micro-electromechanical systems microphones and associated application-specific integrated circuits mounted to printed circuit boards. The application-specific integrated circuits may contain amplifier circuitry for amplifying microphone signals from the microphone. One or more though-silicon vias may be formed in the application-specific integrated circuit that serve as an acoustic port through which sound may pass. The application-specific integrated circuit may be embedded in the printed circuit board and the microphone may be mounted to the upper surface of the printed circuit board, the application-specific integrated circuit and microphone may be stacked on the upper surface of the printed circuit board, or the microphone and application-specific integrated circuit may be mounted to the printed circuit board so that the microphone is received within an opening in the printed circuit board.

19 Claims, 7 Drawing Sheets

(56) References Cited

U.S. PATENT DOCUMENTS

| | | | | |
|---|---|---|---|---|
| 7,940,944 | B2 * | 5/2011 | Song | 381/174 |
| 2007/0111380 | A1 | 5/2007 | Cho et al. | |
| 2008/0075306 | A1 | 3/2008 | Poulsen et al. | |
| 2009/0074222 | A1 * | 3/2009 | Song | 381/357 |
| 2009/0169035 | A1 | 7/2009 | Rombach et al. | |
| 2009/0267223 | A1 * | 10/2009 | Wachtler et al. | 257/710 |
| 2010/0128914 | A1 * | 5/2010 | Khenkin | 381/361 |
| 2010/0183174 | A1 | 7/2010 | Suvanto et al. | |
| 2010/0284553 | A1 | 11/2010 | Conti et al. | |
| 2010/0303273 | A1 * | 12/2010 | Sawada | 381/361 |
| 2012/0008805 | A1 * | 1/2012 | Hachinohe et al. | 381/163 |
| 2012/0027234 | A1 * | 2/2012 | Goida | 381/150 |
| 2012/0087521 | A1 * | 4/2012 | Delaus et al. | 381/174 |

OTHER PUBLICATIONS

Minoo, Jahan, et al. U.S. Appl. No. 12/832,885, filed Jul. 8, 2010.

* cited by examiner

MICROPHONE ASSEMBLIES WITH THROUGH-SILICON VIAS

BACKGROUND

This relates to assemblies of electrical and mechanical components for electronic devices, and, more particularly, to assemblies including acoustic components such as microphones.

Electronic devices often include acoustic components. For example, speakers may be used to produce sound for a user. Microphones may be used to gather audio input signals. In devices such as noise cancelling headphones, microphones may be used to gather ambient noise signals. Microphones may also be used to collect a user's voice or other sound input. For example, microphones may be used in cellular telephone headsets to gather a user's voice during a telephone call.

Space-constrained accessories such as headsets and other electronic equipment may benefit from compact microphones. It can be challenging, however, to reduce the size of conventional microphones. If care is not taken, acoustic quality will be degraded or microphone assemblies will not be sufficiently compact.

It would therefore be desirable to be able to provide improved microphone assemblies.

SUMMARY

Microphone assemblies may be provided that have microelectromechanical systems microphones, associated application-specific integrated circuits, and printed circuit boards. The application-specific integrated circuits may contain amplifier circuitry for amplifying microphone signals from the microphone. The microelectromechanical systems microphones may contain microphone openings that allow sound to reach associated diaphragms.

One or more though-silicon vias may be formed in the application-specific integrated circuit that serve as an acoustic port through which sound may pass. The application-specific integrated circuit may be thinned prior to through-silicon via formation. In the microphone assembly, the a microphone may be aligned with respect to the application-specific integrated circuit so that sound passes through the acoustic port and reaches the microphone diaphragm through the microphone opening.

With one illustrative arrangement, the application-specific integrated circuit may be embedded in the printed circuit board and the microphone may be mounted to the upper surface of the printed circuit board. With another illustrative arrangement, the application-specific integrated circuit and microphone may be stacked on the upper surface of the printed circuit board. With another illustrative arrangement, the microphone and application-specific integrated circuit may be mounted to the printed circuit board so that the microphone is received within an opening in the printed circuit board.

Further features of the invention, its nature and various advantages will be more apparent from the accompanying drawings and the following detailed description of the preferred embodiments.

DETAILED DESCRIPTION

This relates to assemblies that include acoustic components such as microphones and speakers. Illustrative arrangements in which the assemblies are formed from microphones are sometimes described herein as examples, but arrangements that use speakers, combinations of speakers and microphones, or other configurations may be used if desired.

Figure 1:
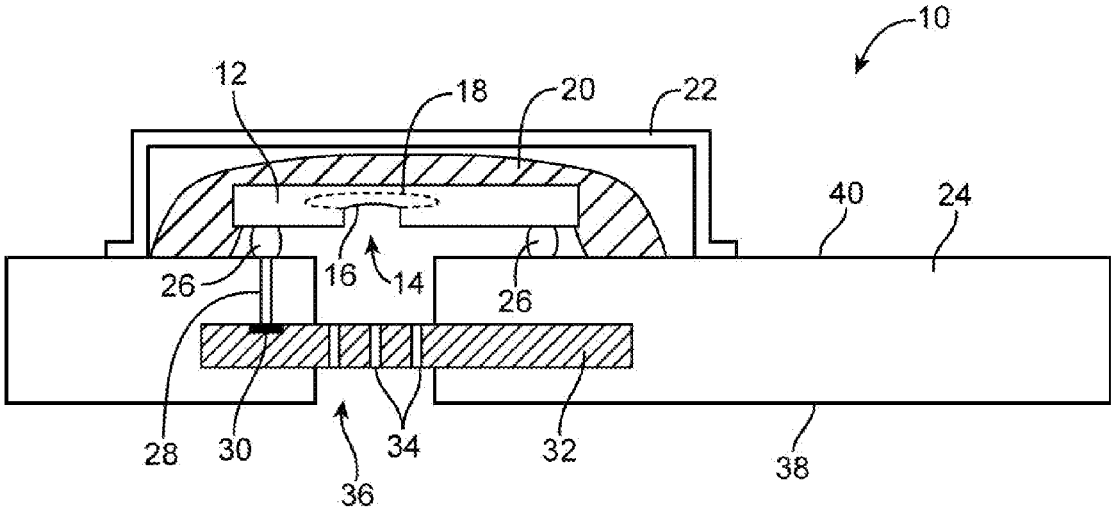
FIG. 1 is a cross-sectional side view of an illustrative microphone assembly with an application-specific integrated circuit that has through-silicon vias that serve as an acoustic port and that has been embedded in a printed circuit board under a microelectromechanical systems microphone in accordance with the embodiment of the present invention.

An illustrative microphone assembly is shown in FIG. 1. As shown in FIG. 1, microphone assembly 10 may be formed by mounting a microphone such as microphone 12 and an associated application-specific integrated circuit such as integrated circuit 32 to a common substrate such as printed circuit board 24. One or more openings in application-specific integrated circuit 32 such as one or more through-silicon vias 34 may serve as an acoustic port for assembly 10. With this arrangement, sound from the surrounding environment may enter microphone opening 14 in microphone 12 through the acoustic port formed from vias 34.

Microphone 12 may be a microelectromechanical systems (MEMs) microphone formed from a silicon substrate or may be a microphone that is implemented using other suitable microphone technologies. As shown in FIG. 1, microphone 12 may have a diaphragm such as diaphragm 16. Diaphragm 16 may be located within microphone opening 14 in the lower surface of microphone 12. An acoustic cavity for microphone 12 may be formed within the same silicon substrate as diaphragm 16 (see, e.g., cavity 18). Arrangements in which cavity 18 is formed within the silicon substrate from which the microphone diaphragm is formed are sometimes referred to as "back volume in die" arrangements. In configurations of the type shown in FIG. 1 in which microphone 12 is mounted efficiently in assembly 10, there may be an increased amount of space available in microphone 12 for forming cavity 18. Increasing the space used for back volume cavity space 18 may help improve microphone performance (e.g., signal-to-noise ratio). Other acoustic cavity configurations may be used for microphone 12 if desired. The use of back volume in die MEMs microphones is merely illustrative.

Application-specific integrated circuit 32 may include circuitry for supporting the operations of microphone 12. For example, application-specific integrated circuit 32 may contain audio amplifier circuitry that amplifies microphone signals from microphone 12 (i.e., application-specific integrated circuit 32 may be an audio integrated circuit with microphone amplifier circuitry). Application-specific integrated circuit 32 may also include ancillary circuitry such as circuits for converting analog microphone signals to digital signals, etc.

For satisfactory operation, it is generally desirable for application-specific integrated circuit 32 to be mounted in the vicinity of microphone 12. In the illustrative configuration of FIG. 1, application-specific integrated circuit 32 is embedded within printed circuit board 24 under MEMs microphone 12 (e.g., by forming a cavity within one or more of the dielectric layers that make up printed circuit board 24 and by mounting circuit 32 in the cavity during the process of forming printed circuit board 24). Printed circuit board 24 may be a rigid printed circuit board (e.g., a fiberglass-filled epoxy printed circuit board such as an FR-4 printed circuit board) or a flexible printed circuit board.

One or more through-silicon vias 34 (i.e., openings that pass through the silicon die used to form application-specific integrated circuit 32) may be used to form an acoustic port (i.e., a passageway that allows sound to pass through integrated circuit 32). Vias 34 may be formed by etching (e.g., dry and/or wet etching). To facilitate via formation, application-specific integrated circuit 32 may be thinned before vias 34 are etched. For example, application-specific integrated circuit 32 may be thinned to a thickness of about 50-300 microns (e.g., 100-200 microns) by polishing (e.g., using chemical-mechanical polishing operations).

Opening 36 in printed circuit board 24 may pass through printed circuit board from lower surface 38 to upper surface 40 and may be aligned with the acoustic port in integrated circuit 32 formed from through-silicon vias 34. This allows sound to pass through opening 36 and the acoustic port in application-specific integrated circuit 32 to reach microphone opening 14 of microphone 12 and diaphragm 16.

Diaphragm 16 and the audio circuitry on application-specific integrated circuit 32 may be interconnected using solder, conductive traces, and other suitable interconnect paths. As shown in FIG. 1, for example, solder balls 26 may be used to mount microphone 12 to upper surface 40 of printed circuit board 24. Vias such as via 28 (e.g., laser vias or other suitable vias) may be formed in printed circuit board 24 to connect solder bumps 26 to circuitry on application-specific integrated circuit (shown by the interconnect of via 28 and trace 30 on application-specific integrated circuit 32 in the FIG. 1 example).

If desired, an encapsulant layer such as layer 20 (e.g., an epoxy layer or other suitable material) may be used to form an environmental seal for microphone 12. Shield 22 may help to reduce electrical interference and may help protect microphone 12 from environmental exposure.

Figure 2:
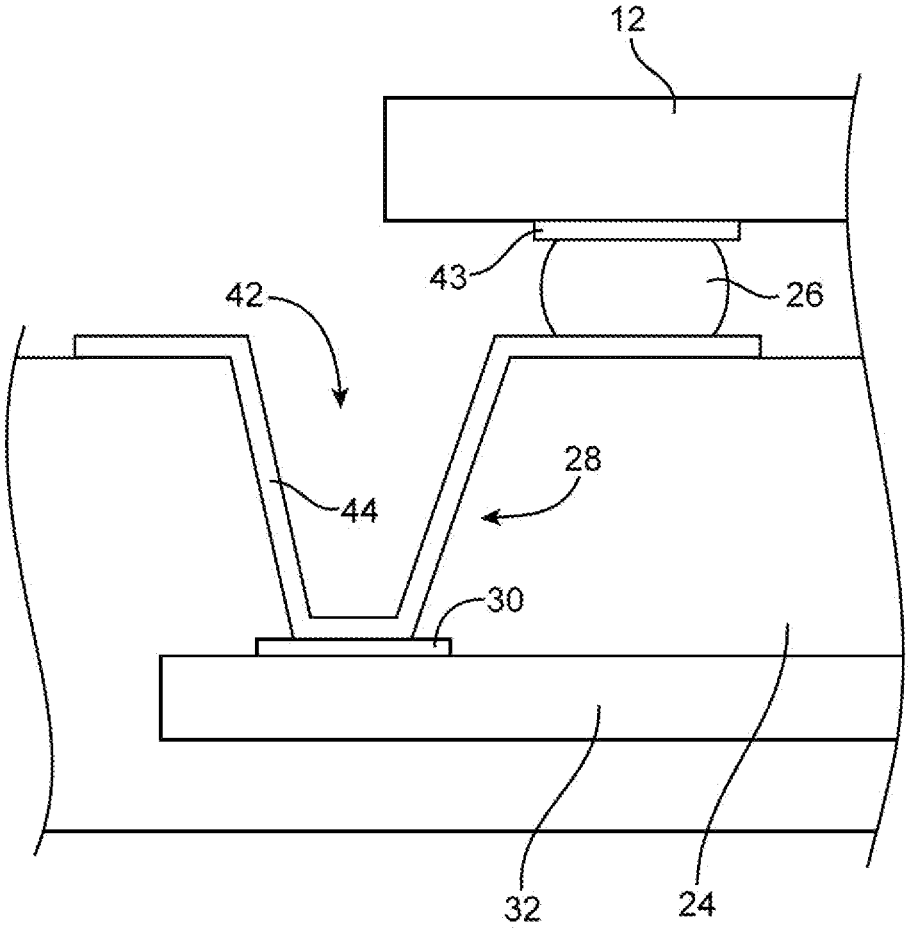
FIG. 2 is a cross-sectional side view of a portion of the illustrative microphone assembly of FIG. 2 in the vicinity of a via in accordance with an embodiment of the present invention.

FIG. 2 is a cross-sectional side view of via 28 of FIG. 1. As shown in FIG. 2, via 28 may have metal 44 that is formed within via opening 42. Metal 44 may interconnect solder ball 26 to trace 30 on application-specific integrated circuit 32. Microphone 12 may have traces such as pad 43. Pad 43 may be electrically coupled to diaphragm 16 (FIG. 1). When mounting microphone 12, solder ball 26 may interconnect pad 43 to via metal 44 in via 28. Printed circuit 24 may contain traces that interconnect microphone 12 and application specific integrated circuit to wires and other circuitry in an electrical device.

Figure 3:
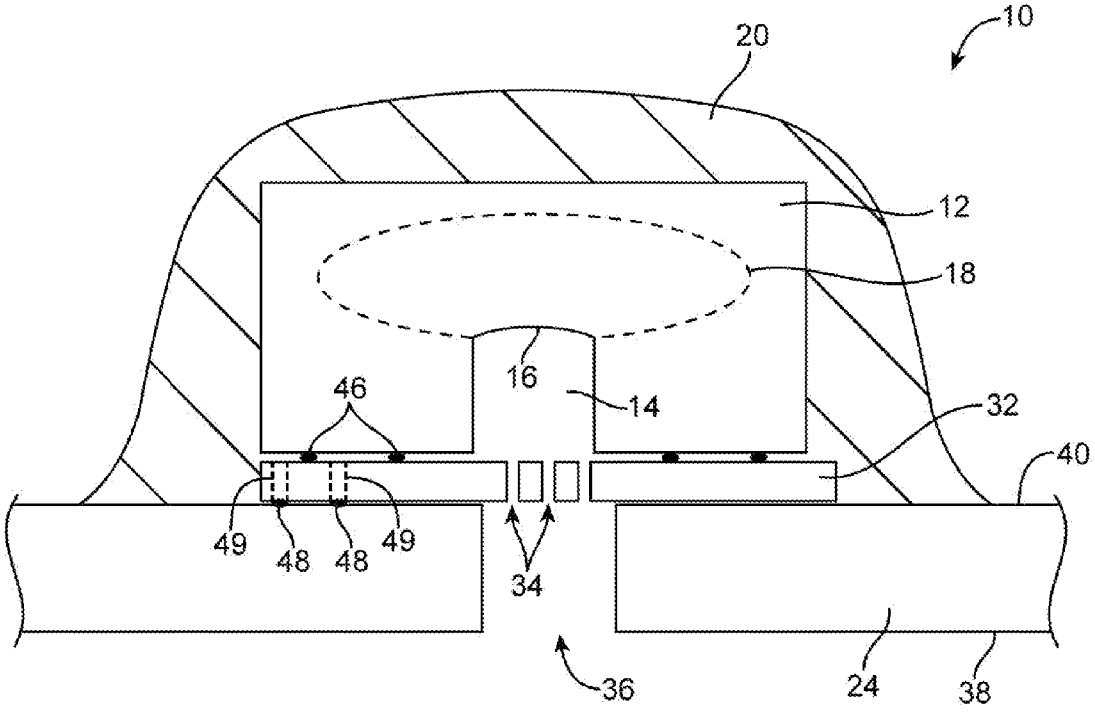
FIG. 3 is a cross-sectional side view of an illustrative microphone assembly that includes an application-specific integrated circuit with through-silicon vias that serve as an acoustic port mounted on the surface of a printed circuit board under a microelectromechanical systems microphone in accordance with an embodiment of the present invention.

If desired, microphone 12 and application-specific integrated circuit 32 may be mounted on upper surface 40 of printed circuit board 24. As shown in FIG. 3, for example, application-specific integrated circuit 32 may be a double-sided integrated circuit that has solder pads on both its upper and lower surfaces. Active circuitry may be formed on one of the two surfaces of application-specific integrated circuit 32 (e.g., the upper surface). Through-silicon vias such as vias 49 that are filled with metal may be used in forming interconnects that route signals from the upper surface of application-specific integrated circuit 32 to the lower surface of application-specific integrated circuit.

Solder pads on the upper surface of application-specific integrated circuit 32 may be soldered to corresponding solder pads on the lower surface of microphone 12 using solder 46. Solder pads on the lower surface of application-specific integrated circuit 32 may be soldered to corresponding solder pads on upper surface 40 of printed circuit board 24 using solder 48.

Application-specific integrated circuit 32 may have one or more through-silicon vias 34 that form an acoustic port. Opening 36 in printed circuit board 24 may pass through printed circuit board 24 from lower surface 38 to opposing upper surface 40 and may be aligned with the acoustic port. Sound may travel through opening 36, the acoustic port formed from through-silicon vias 34, and opening 14 in microphone 12 to reach diaphragm 16. As shown by dashed acoustic cavity line 18, microphone 12 may have a back volume in die configuration. Microphone 12 and application-specific integrated circuit 32 may be covered with encapsulant 20.

Figure 4:
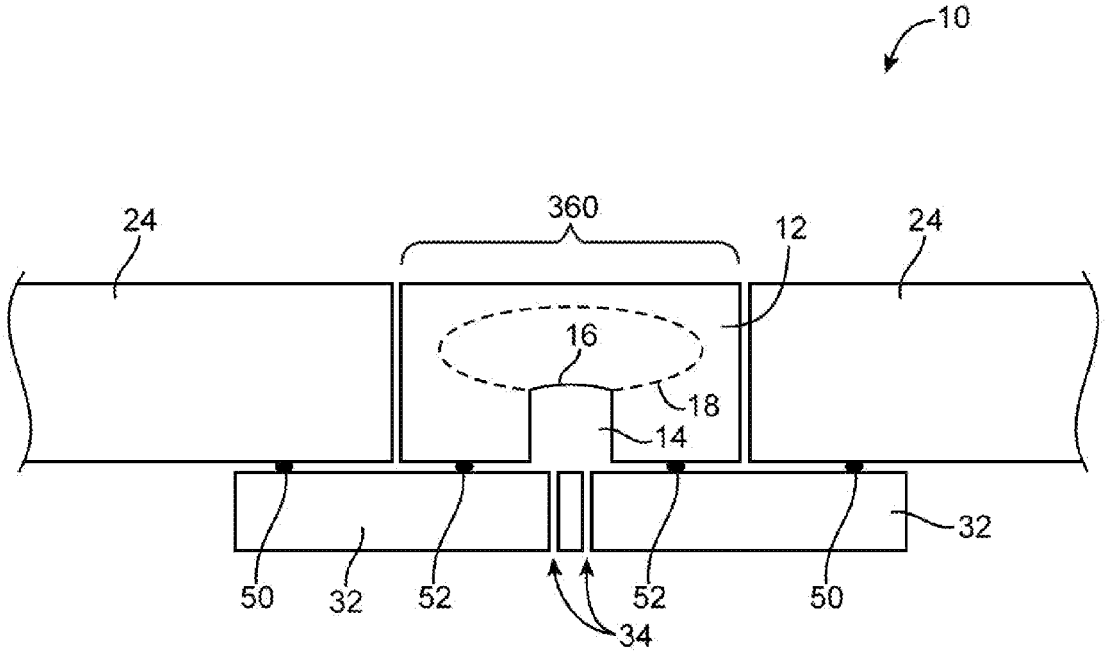
FIG. 4 is a cross-sectional side view of an illustrative microphone assembly in which a microelectromechanical systems microphone has been mounted in an opening in a printed circuit board and in which an application-specific integrated circuit with through-silicon vias that serve as an acoustic port has been mounted under the microelectromechanical systems microphone in accordance with an embodiment of the present invention.

In the illustrative arrangement of FIG. 4, microphone 12 has been mounted in opening 360 in printed circuit board 24. Opening 360 may pass entirely through printed circuit board 24 or may pass only partly through printed circuit board 24 (e.g., to form a cavity that receives all or part of microphone 12).

Application-specific integrated circuit 32 may have one or more through-silicon vias 34 that form an acoustic port. This allows sound to pass through application-specific integrated circuit 32 to reach opening 14 and diaphragm 16 of microphone 12.

Microphone 12 may be mounted on the upper surface of application-specific integrated circuit 12 using solder balls 52. Application-specific integrated circuit 32 may be mounted to the underside of printed circuit board 24 using solder balls 50.

In the illustrative configurations of FIGS. 1 and 4, application-specific integrated circuit 32 may be a single-sided circuit (i.e., a circuit that contains active circuitry and interconnect traces only on one surface without through-silicon vias for forming back-side connections).

Figure 5:
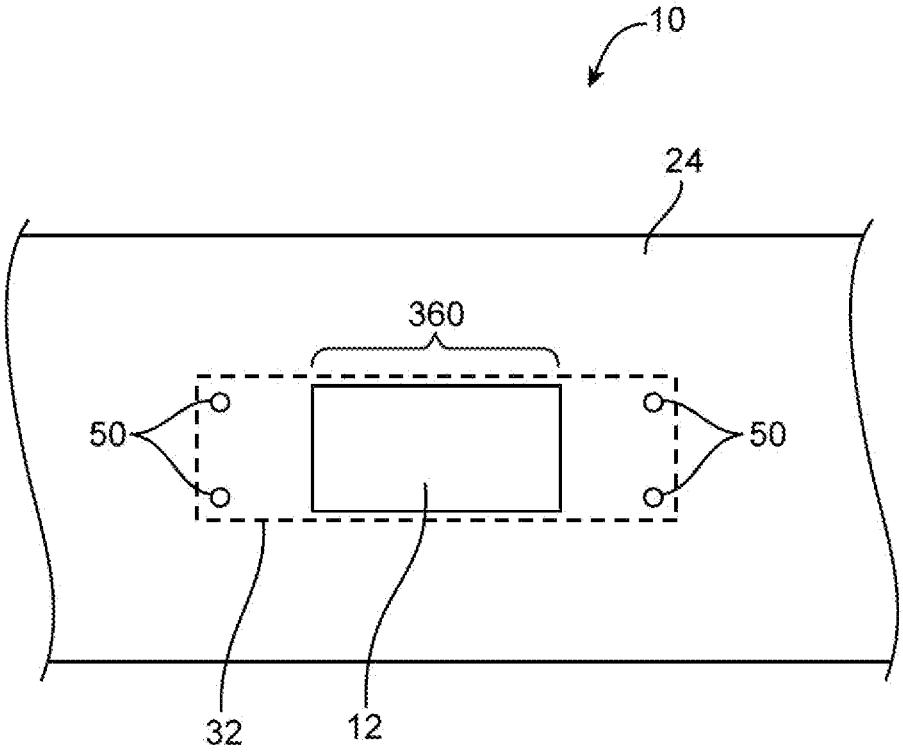
FIG. 5 is a top view of a microphone assembly of the type shown in FIG. 4 in accordance with an embodiment of the present invention.

A top view of the microphone assembly of FIG. 4 is shown in FIG. 5. As shown in FIG. 5, opening 360 may have a rectangular outline for receiving microphone 12. Solder balls 50 may be arranged around the periphery of microphone 12 on the underside of printed circuit board 24 to mount application-specific integrated circuit 32 to the underside of printed circuit board 24.

Figure 6:
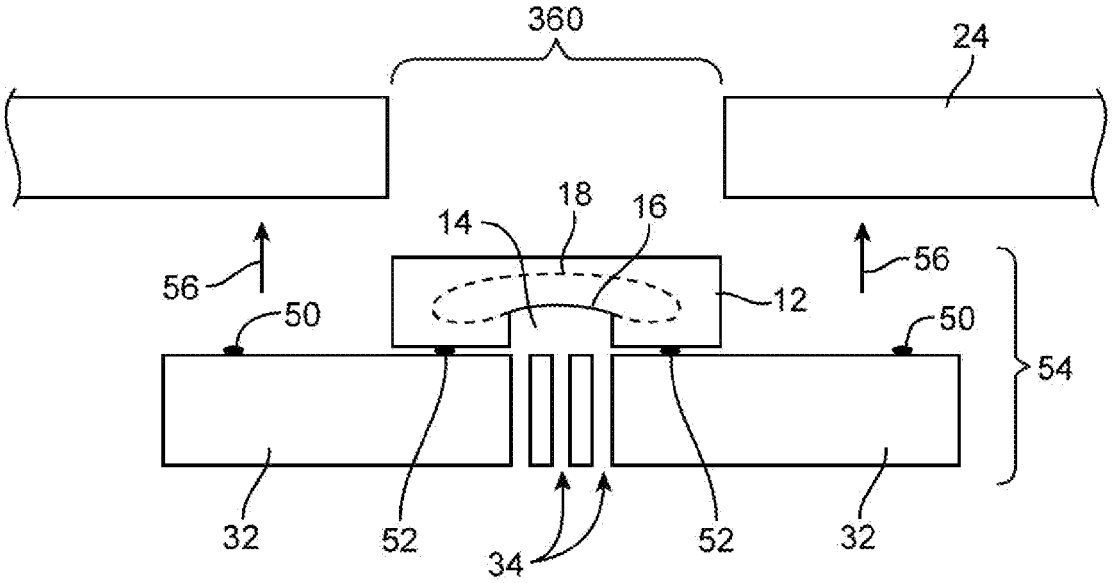
FIG. 6 is an exploded cross-sectional side view of a microphone assembly of the type shown in FIGS. 4 and 5 showing how the microphone assembly may be assembled in accordance with an embodiment of the present invention.

Microphone assembly 10 of FIGS. 4 and 5 may be formed using a process of the type illustrated in FIG. 6. As shown in FIG. 6, microphone 12 may be mounted on application-specific integrated circuit 32 using solder balls 52 to form stacked die assembly 54. Following formation of stacked die assembly 54, stacked die assembly 54 may be moved in direction 56 to insert microphone 12 into opening 360 of printed circuit board 24. Once microphone 12 has been inserted into opening 360, stacked die assembly 54 may be mounted to the lower surface of printed circuit board 24 by attaching application-specific integrated circuit 32 to printed circuit board 24 with solder 50.

Figure 7:
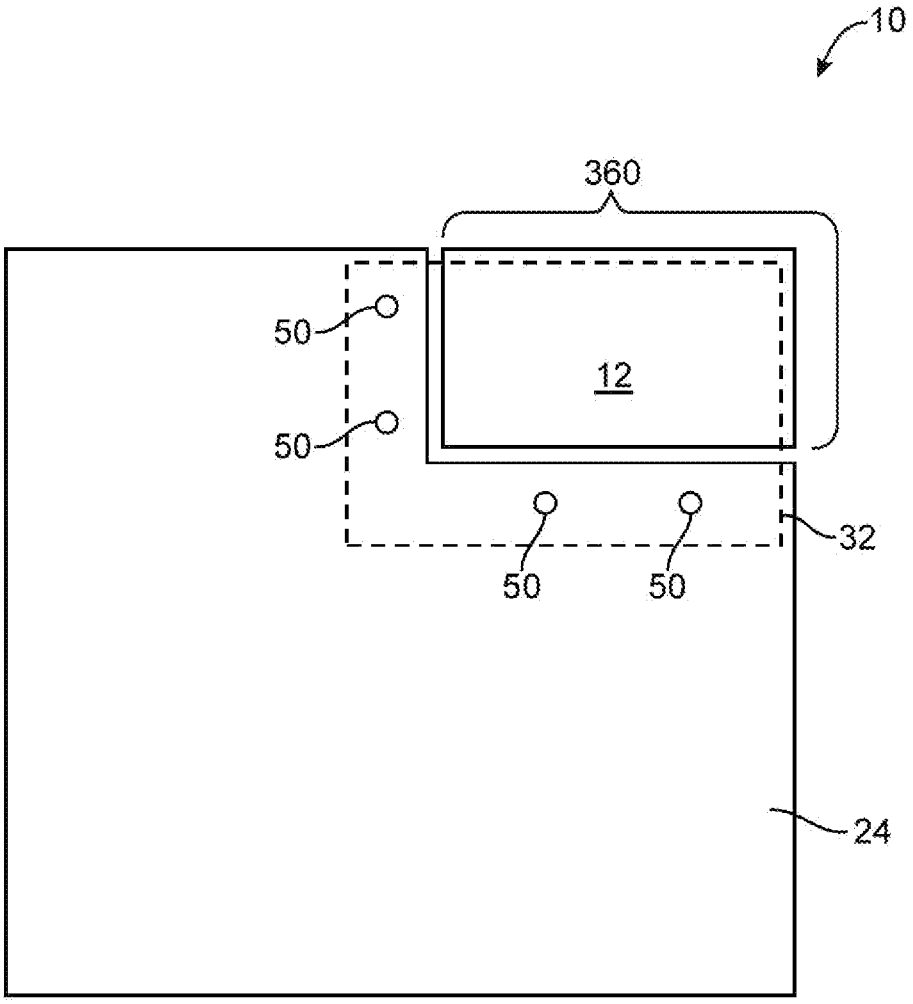
FIG. 7 is a top view of an illustrative microphone assembly in which a microelectromechanical systems microphone has been mounted in a corner opening in a printed circuit board in accordance with an embodiment of the present invention.

FIG. 7 is a top view of an illustrative microphone assembly in which opening 360 in printed circuit board 24 has been formed in a corner of printed circuit board 24. Solder 50 may be used to mount application-specific integrated circuit 32 to the underside of printed circuit board 24 within opening 360. In the configuration of FIG. 7, opening 360 has the shape of a notch that is open on at least some edges (e.g., the upper and right edges in the FIG. 7 example). In general, opening 360 may have any suitable shape (e.g., a closed opening with a periphery that is completely surrounded by portions of printed circuit board 24 or other suitable substrates, a slot-shaped opening that has an open side and that is otherwise closed, a notch-shaped corner opening of the type shown in FIG. 7, openings that pass through the entire thickness of printed circuit board 24, openings that pass only partway through printed circuit board 24, etc.). Shapes such as these may, if desired, be used for the cavity in printed circuit board 24 that encloses (or partially encloses) application-specific integrated circuit 32 of FIG. 1 and openings such as openings 36 of FIG. 1 and FIG. 3.

Although sometimes described in connection with solder connections, the electrical and mechanical connections that are formed in microphone assembly 10 may be formed using any suitable connection mechanisms. For example, connections may be formed using conductive springs, conductive screws, welds, conductive adhesive, or other suitable conductive materials. The use of solder joints in electrically and mechanically connecting the components of microphone assembly 10 to each other is merely illustrative.

The foregoing is merely illustrative of the principles of this invention and various modifications can be made by those skilled in the art without departing from the scope and spirit of the invention.

What is claimed is:

1. A microphone assembly, comprising:

a printed circuit board having a top surface, a bottom surface, and an opening passing through the bottom surface;

an integrated circuit having a top surface, a bottom surface, and at least one through-silicon via that forms an acoustic port through the top and bottom surfaces of the integrated circuit; and a microphone, separate from the integrated circuit, that is mounted to a portion of the top surface of the integrated circuit so that the microphone receives sound through the acoustic port of the integrated circuit;

wherein the top surface of the integrated circuit is mounted to the bottom surface of the printed circuit board so that the microphone is positioned within the opening of the printed circuit board and the integrated circuit is positioned outside of the opening of the printed circuit board, wherein the opening has at least one peripheral edge that is open and not surrounded by the printed circuit board.

2. The microphone assembly defined in claim 1, wherein the opening of the printed circuit board passes through the top surface of the printed circuit board and through the bottom surface of the printed circuit board.

3. The microphone assembly defined in claim 1, wherein the opening of the printed circuit board passes through the bottom surface of the printed circuit board and not through the top surface of the printed circuit board.

4. The microphone assembly defined in claim 1, wherein the microphone is positioned entirely within the opening of the printed circuit board.

5. The microphone assembly defined in claim 1, wherein the microphone is positioned only partly within the opening of the printed circuit board.

6. The microphone assembly defined in claim 1, further comprising solder with which the microphone is directly mounted to the integrated circuit.

7. The microphone assembly defined in claim 1, further comprising solder with which the integrated circuit is directly mounted to the printed circuit board.

8. The microphone assembly defined in claim 1, wherein the integrated circuit has a thickness in the range of 50 to 300 microns.

9. The microphone assembly defined in claim 1, wherein the integrated circuit comprises the through-silicon via layered with metal.

10. The microphone assembly defined in claim 1, wherein the microphone comprises a microelectromechanical systems microphone formed from a silicon substrate, wherein the microphone has a diaphragm, wherein the silicon substrate has a microphone opening aligned with the diaphragm, wherein the microphone opening is aligned with the acoustic port so that sound is received by the diaphragm through the acoustic port and the microphone opening.

11. The microphone assembly defined in claim 1, wherein the integrated circuit has at least some metal-filled through-silicon vias that form electrical paths between the top and bottom surfaces of the integrated circuit, the microphone assembly further comprising solder with which the microphone is soldered to the top surface of the integrated circuit and with which the integrated circuit is soldered to the printed circuit board.

12. The microphone assembly defined in claim 1, further comprising solder with which the integrated circuit is mounted to the printed circuit board and with which the microphone is mounted to the integrated circuit, wherein the integrated circuit has a thickness of 50 to 300 microns and wherein the integrated circuit includes amplifier circuitry that amplifies a microphone signal from the microphone.

13. The microphone assembly defined in claim 2, further comprising solder with which the microphone is mounted to the integrated circuit, solder with which the integrated circuit is mounted to the printed circuit board, wherein the microphone is positioned entirely within the opening of the printed circuit board, and wherein the integrated circuit has a thickness in the range of 50 to 300 microns.

14. The microphone assembly defined in claim 2, further comprising solder with which the microphone is mounted to the integrated circuit, solder with which the integrated circuit is mounted to the printed circuit board, wherein the microphone is positioned only partly within the opening of the printed circuit board, and wherein the integrated circuit has a thickness in the range of 50 to 300 microns.

15. The microphone assembly defined in claim 3, further comprising solder with which the microphone is mounted to the integrated circuit, solder with which the integrated circuit is mounted to the printed circuit board, wherein the microphone is positioned entirely within the opening of the printed circuit board, and wherein the integrated circuit has a thickness in the range of 50 to 300 microns.

16. The microphone assembly defined in claim 3, further comprising solder with which the microphone is mounted to the integrated circuit, solder with which the integrated circuit is mounted to the printed circuit board, wherein the microphone is positioned only partly within the opening of the printed circuit board, and wherein the integrated circuit has a thickness in the range of 50 to 300 microns.

17. The microphone assembly defined in claim 1, further comprising solder with which the microphone is mounted to the integrated circuit, solder with which the integrated circuit is mounted to the printed circuit board, and wherein the integrated circuit has a thickness in the range of 50 to 300 microns.

18. A process for making a microphone assembly, comprising:

forming a stacked die assembly by mounting a microphone to a top surface of an integrated circuit having at least one through-silicon via that forms an acoustic port so that the microphone is capable of receiving sound through the acoustic port;

inserting the microphone into an opening of a printed circuit board so that the microphone is positioned within the opening, wherein the printed circuit board has a top surface and a bottom surface and has at least one peripheral edge that is open and not surrounded by the printed circuit board; and mounting the stacked die assembly to the printed circuit board by attaching the top surface of the integrated circuit to the bottom surface of the printed circuit board so that the integrated circuit is positioned outside of the opening of the printed circuit board.

19. The process of claim 18, wherein the microphone is positioned entirely within the opening.

* * * * *